United States Patent [19]

Stuart

[11] 4,375,943

[45] Mar. 8, 1983

[54] EMBANKMENT PUMP

[76] Inventor: Clifford H. Stuart, P.O. Box 367, Indiantown, Fla. 33456

[21] Appl. No.: 199,459

[22] Filed: Oct. 22, 1980

[51] Int. Cl.[3] ..... F04B 17/06; F04B 35/06

[52] U.S. Cl. ..... 417/231; 417/234; 280/789

[58] Field of Search ..... 417/231, 234; 280/789

[56] References Cited

U.S. PATENT DOCUMENTS

| | | | |
|---|---|---|---|
| 3,008,422 | 11/1961 | Crisafulli | 417/234 |
| 3,217,654 | 11/1965 | Springer | 417/231 |
| 3,371,614 | 3/1968 | Crisafulli | 417/231 |
| 3,490,380 | 1/1970 | Beckett | 417/234 |
| 3,910,722 | 10/1975 | Hochmuth | 417/34 |
| 3,915,594 | 10/1975 | Nesseth | 417/231 |
| 3,966,361 | 6/1976 | House | 417/231 |

*Primary Examiner*—Richard E. Gluck
*Assistant Examiner*—Peter M. Cuomo
*Attorney, Agent, or Firm*—Malin & Haley

[57] ABSTRACT

A portable pump for displacing water having a frame supported by ground contacting wheels for transport, an elongated tubular conduit with an impeller mounted therein and a drive shaft with one end connected to the impeller and the other end having a non complex universal bearing joint for detachably coupling directly to a driving motor shaft of a farm tractor or other prime mover. The drive shaft exits the tubular conduit on the underside so that the angle between the driving motor shaft and impellar drive shaft is at a minimum angle when the tubular conduit inlet end is tilted below horizontal in order to submerge the inlet end of the conduit into the water from the edge of a steep irrigation bank. This enables the portable pump with the non complex universal bearing joining to be backed onto the bank of a water source such as an irregation canal, stream, or lake. A casing around the drive shaft allows the shaft to become embedded into the crest of the bank allowing the inlet portion to be submerged.

2 Claims, 8 Drawing Figures

EMBANKMENT PUMP

BACKGROUND OF THE INVENTION

Heretofore, many portable irrigation and water pump devices have been used which are adaptable to trucks and tractors and connectable to their power source. The problem inherent in displacing water from a canal, lake, or river, is that the impeller must be submerged while the prime mover or power source must not be. Often, rather high banks are encountered that would place an impeller drive shaft end exiting from the top side of the tubular conduit too high to connect to a tractor or truck power source without additional transmission linkage.

The present invention is an improvement on previous devices in that the impeller drive shaft exits the water conduit from the underside and is encased in a protective housing which allows the shaft to become embedded in the earth bank. Thus, the conduit may be "step" shaped in order to lay over the bank allowing the inlet to be submerged while the impeller drive shaft is directly connected to the tractor or truck power source through a simple universal bearing joint.

BRIEF SUMMARY OF THE INVENTION

The present invention relates to a new and an improved portable pump with a noncomplex universal bearing joint mounted on ground contacting wheels for transport. The portable pump includes an impeller mounted within an elongated tubular conduit near the inlet end which is submerged during operation. The elongated tuberlar conduit has a new and improved shape. The conduit profile approximately conforms to a design making it more useful on the banks of a typical canal, river, or lake. The impeller drive shaft exits through the bottom of the conduit wall on the underside of the conduit near the inlet portion and extends to a drive shaft bearing and bracket connected to the discharge level portion adjacent the discharge end of the conduit. Also connected to the discharge end portion is a trailer hitch device for connecting to a tractor or truck for transport.

Forward of the drive shaft bearing is a universal joint connected to the impeller drive shaft for attachment to the truck or tractor prime power source. The new and improved portable pump may be hitched to a tractor and backed down the bank of a water source in order to submerge the inlet portion into the water. The impeller shaft with its non complex universal joint can be easily attached to the tractor drive shaft through a mating connection means commonly provided at the rear of most tractor vehicles. In this configuration the impeller is powered directly by the tractor motor as the prime power source.

The impeller shaft on the underside of the conduit is encased in a protective housing which will allow the shaft to turn even though it is embedded in the earth bank. By allowing the shaft to embed into the earth bank. The angle of the center line of each tubular conduit section from horizontal will be substantially less, that is smaller, than that of the phantom center line in a straight pipe pump. Thus, the connection means on the forward end of the shaft will be low enough, that is at a shallow enough angle, to connect directly to the shaft of the tractor's prime power source by a non complex low cost universal joint. The smaller angle and direct connection method eliminates the need for additional expensive gear boxes for mating the tractor shaft to the impeller shaft.

It is an object of this invention to provide a portable irrigation pump with an impeller drive shaft directly connectable to the prime power source drive shaft by a non complex universal joint that provides a relatively shallow connecting angle because of the tubular conduit design and embeding external shaft housing.

It is yet another object of this invention to provide a portable irrigation pump with an external impeller shaft housing on the underside of the main conduit that is shaped to allow the shaft to easily embed itself into an embankment during operation.

It is still another object of this invention to provide a portable irrigation pump which may be backed down an embankment to submerge the inlet portion while the prime power source remains substantially horizontal on the upper portion of the embankment and the angle between the prime cover and the impeller drive shaft is held to a minimum.

In accordance with these and other objects which will be apparent hereinafter, the instant invention will now be described with particular reference to the accompanying drawings.

ONE PREFERRED EMBODIMENT OF THE INVENTION

Figure 1:
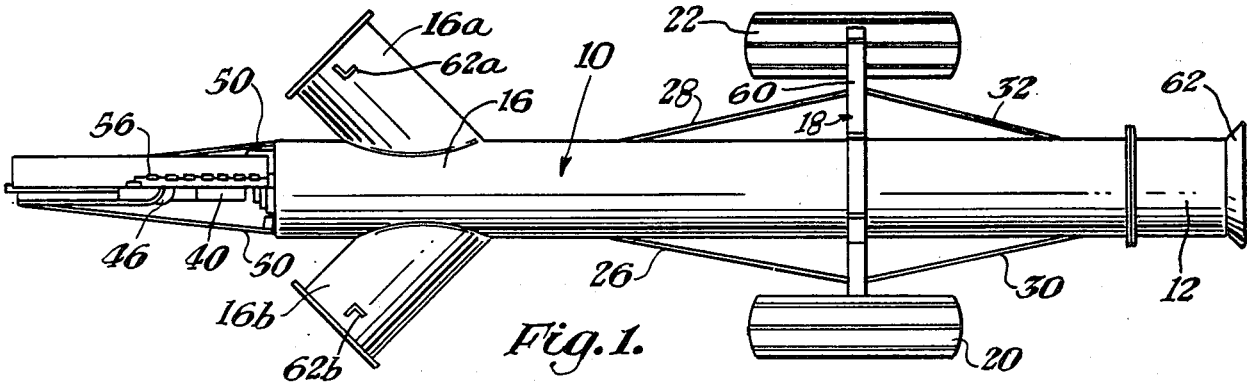
FIG. 1 is a top plan view of the portable pump.
Figure 2:
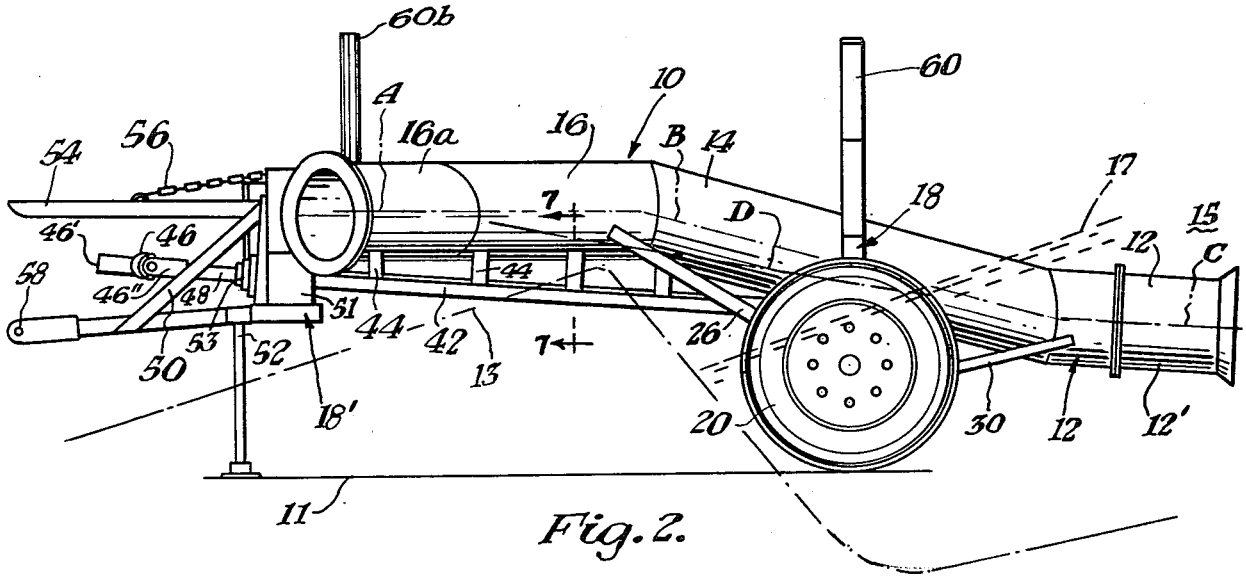
FIG. 2 is a side view elevation of the pump shown in FIG. 1 with phantom lines for illustration purposes.

Referring now to FIGS. 1 through 5, one preferred embodiment of the invention is shown as comprising a tubular conduit 10 having an inlet section 12, a middle section or riser ection 14 and a discharge section 16. In its normal level position for transportation on roadways 11 shown in FIG. 2, the inlet section 12 is substantially horizontal, the riser section 14 is inclined upwardly from the inlet section to the discharge section 16 which is also substantially horizontal.

The discharge end may be a single opening or a dual opening 162 and 166.

Figure 3:
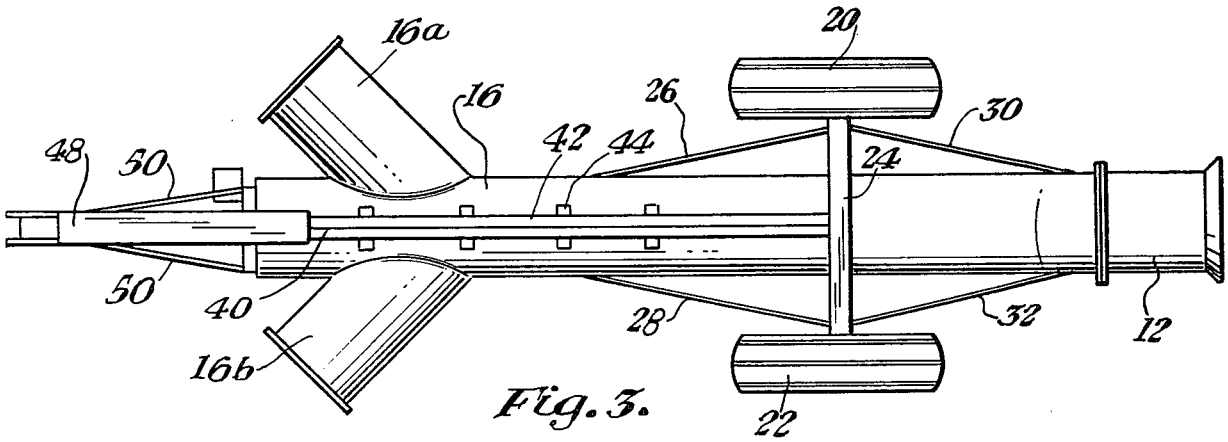
FIG. 3 is a bottom view of the pump shown in FIG. 1.
Figure 4:
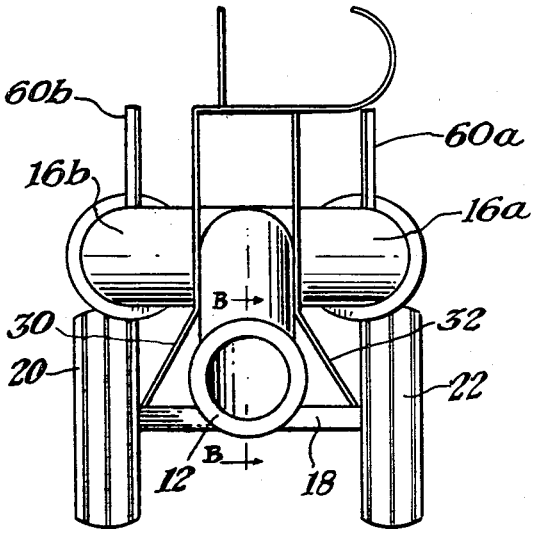
FIG. 4 is a rear elevation view of the pump shown in FIG. 1.
Figure 5:
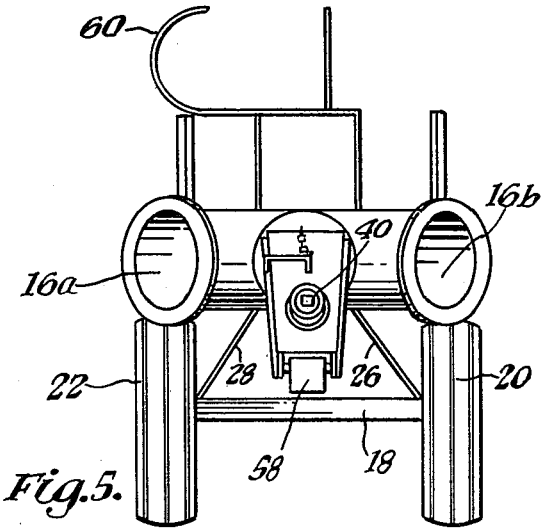
FIG. 5 is a front elevation view of the pump shown in FIG. 1.

The tubular conduit 10 is mounted on a trailer frame 18 shown in FIGS. 1, 2, 4 and 5 with ground contacting wheels 20 and 22 and an axle 24 shown in FIG. 3 therebetween and support braces 26, 28, 30, and 32. The front support braces 26 and 28 extend from opposite axle ends and attach to their respective sides of the discharge section 16. The rear support braces 30 and 32 extend from opposite axle ends and attach to their respective side of the inlet section 12. The trailer frame 18 includes a forward frame portion 18' enclosing a trailer hitch and the drive shaft housing. Connected to the trailer frame 18 is a front bracket supports 60*a* and 60*b* and rear bracket support 60 for storing and holding additional tubular conduit links (not shown) which may be used as extentions on either the discharge sections 16*a* and 16*b* or the inlet section 12. The rear flanges 62 or forward flanges 62*a* and 62*b* may be used to secure additional pipes or conduits to the inlet and/or discharge outlet of the portable pump.

The forward discharge section 16 in this embodiment has two discharge segments 16*a* and 16*b* from which the pumped water can be released on either side of the drive shaft 40 which connects to the driving means or prime mover of a land vehicle (not shown). The prime mover may be a tractor or truck. The drive shaft 40 is protected by a drive shaft housing 42. The drive shaft extends from universal joint 46 to impeller 60 shown in FIG. 8. Because of the weight of the irrigation pump, the drive shaft housing may embed itself in the top of an embankment 13 shown in FIG. 2 in phantom about the water source 15 shown in FIG. 2 enabling the inlet Section 12 to be submerged below the surface 17. The drive shaft support housing 42 is connected to the underside of the tubular conduit 10 by way of vertical support members 44. The drive shaft 40 can be connected to the driving means of the land vehicle (not shown) by way of a non complex universal joint 46 having a first member 46′ and a second member 46″. The shape and size of the tubular conduit 10 and positioning of the drive shaft all the universal joint to be used instead of requiring a gear box to provide an acceptable angular relationship between the prime mover and the drive shaft 40. The trailer frame 18 is also connected to a land vehicle by way of a trailer hitch 58. The trailer hitch 58 is connected to elongated member 48 which is welded to the front portion 18′ of the trailer frame 18. Brace members 50 support member 48. Members 50 are connected to that front of member 16. Members 51 may also be used to support member 48. When not in use the pump can be maintained in a position easily accesible by a land vehicle by way of the jack 52 which supports hitch member 48. A drive shaft guard 53 is hingedly connected to the front portion 18′ of the trailer frame 18 and supported by the chain 56 so it can be positioned to provide protection when the drive shaft is rotating.

Figure 6:
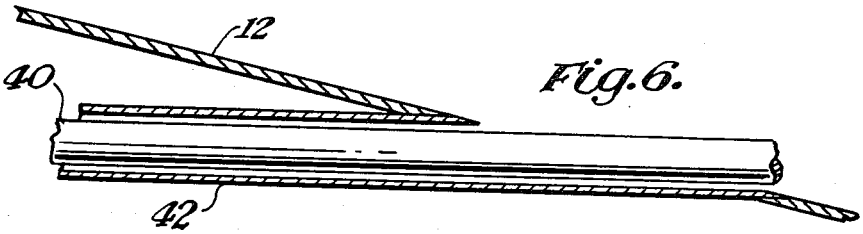
FIG. 6 is a partial cross sectional view of the drive shaft support housing illustrating the impeller shaft exiting the middle section of tubular conduit.
Figure 7:
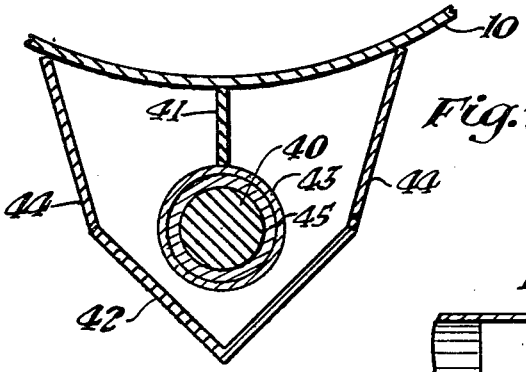
FIG. 7 is a partial cross sectional view of the impeller shaft and housing taken along 7—7 of FIG. 2 and looking in the direction of the arrows.

Referring to FIGS. 6 and 7, the drive shaft 40 is shown exiting the inlet section 12 of the tubular conduit encased by the drive shaft housing 42. The drive shaft housing 42 is pointed on the bottom in order to aid in embeding it in the embankment around the water source. The support members 41 and 43 support bearing 45.

Figure 8:
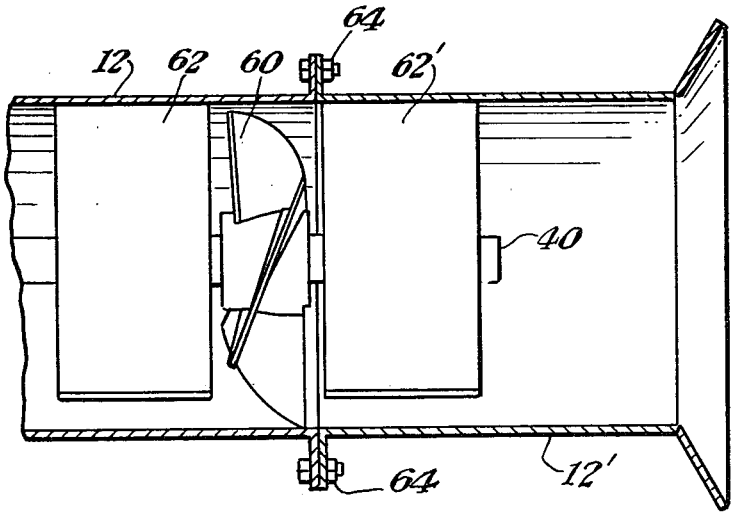
FIG. 8 is a partial cross sectional view of the inlet portion, impeller, and impeller supports.

Referring now to FIG. 8, the inlet section 12 is shown with the impeller 60 housed therein and supported by the shaft support assemblies 62 and 62′. A portion of the inlet section 12 can be removed by removing the nuts and bolts 64 from pipe flunges in order to remove end section 12′ to service the impeller. The forward shaft support assembly 62 and aft shaft support assembly 62′, support the drive shaft 40 with the impeller 50 there between. Bearing may be placed around the shaft at each support location.

In use the new and improved portable pump having center line A in section 16, center line B in section 14 and center line C in section 12 is of such a design having an external shaft that embeds itself in a bank that center lines A, B, or C are less in degrees to the horizontal than a straight pipe from inlet to outlet as illustrated by phantom center line D. A straight pipe would hold itself on the banks edge. The shape of the tubular conduit and embeding shaft housing location and universal joint drive connection provide for a new and improved pump. The angle between the inlet portion and the mid portion is an acute angle. The preferred angle is between 20 and 40 degrees. The preferred greatest distance between the drive shaft and the mid portion is between 6 inches and 2½ feet.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An embankment pump, connectable to a prime mover having a substantially horizontally oriented prime power source, positionable on the top of an embankment of a body of water comprising:

an elongated tubular conduit, said tubular conduit having an inlet portion submergeable in a body of water;

a riser portion fluidly connected to said inlet portion, said riser portion angled upward in an acute angle from said inlet portion to said riser portion to raise fluid flow from said inlet portion to an outlet portion over said top of an embankment of a body of water;

at least one outlet portion fluidly connected to said riser portion, a frame connected to said conduit, at least one wheel rotatable connected to said frame, a drive shaft housing means connected beneath a portion of said tubular conduit by a plurality of vertical support members, said drive shaft housing means for providing penetration of the top of said embankment, said drive shaft housing means partially encloses a support bearing housing a drive shaft during penetration of said embankment allowing unhindered rotation of said drive shaft when embedded in said embankment; said support bearing attached to said tubular conduit by support members;

the drive shaft having a first end and a second end, said drive shaft rotatably mounted within said support bearing, said first end connected to said prime power source, said second end connected to an impeller, said drive shaft insertable into said tubular conduit maintaining said first end at a generally horizontal position to said prime power source when said inlet portion is submerged in a body of water and said riser portion and drive shaft housing means is positioned astride an embankment of said body of water, the impeller, rotatably mounted within said conduit and operably connected to said second end of said drive shaft;

said drive shaft housing means embedded in said embankment while said inlet portion is submerged in a body of water and said first end at a generally horizontal position to said prime power source, centerlines of said inlet portion, said riser portion and said outlet portion having relative angular displacements less in degrees from the horizontal than a single straight portion placed on top of said embankment.

2. An embankment pump as set forth in claim 1 including:

a universal joint connecting said first end and said prime power source.

* * * * *